United States Patent [19]

Brown

[11] Patent Number: 4,485,940

[45] Date of Patent: Dec. 4, 1984

[54] DILUENT VALVE ACTUATOR ASSEMBLY FOR BEVERAGE DISPENSERS

[75] Inventor: Wade R. Brown, St. Charles, Ill.

[73] Assignee: The Coca-Cola Company, Atlanta, Ga.

[21] Appl. No.: 516,138

[22] Filed: Jul. 21, 1983

Related U.S. Application Data

[63] Continuation of Ser. No. 343,560, Jan. 28, 1982, abandoned.

[51] Int. Cl.[3] ..... B67D 5/56

[52] U.S. Cl. ..... 222/129.1; 74/519; 200/330; 141/84

[58] Field of Search ..... 222/129, 129.1, 144.5, 222/288; 74/519, 555, 556; 137/377; 141/84; 200/153 T, 330

[56] References Cited

U.S. PATENT DOCUMENTS

| | | | |
|---|---|---|---|
| 3,289,948 | 12/1966 | Fuerst | 239/129 |
| 3,540,476 | 11/1970 | Fuerst | 137/251 |
| 3,727,844 | 4/1973 | Bencic | 239/222 |
| 4,266,726 | 5/1981 | Brown et al. | 222/129.1 X |

*Primary Examiner*—Joseph J. Rolla
*Assistant Examiner*—Kevin P. Shaver

[57] ABSTRACT

An improved diluent valve actuator for a soft drink beverage dispenser serves dual functions. The first function, accomplished when the actuator is in a first operative position, is to actuate the solenoid controlled valve for the beverage diluent (such as carbonated water) when the actuator is pressed by an operator. The second function, accomplished when the actuator is in a second non-operative position is to act as a cover over the opening in the dispenser where the actuator would have extended if the actuator were in the first position. In the second position, the remainder of the actuator is concealed within the beverage dispenser out of view.

2 Claims, 8 Drawing Figures

FIG-3
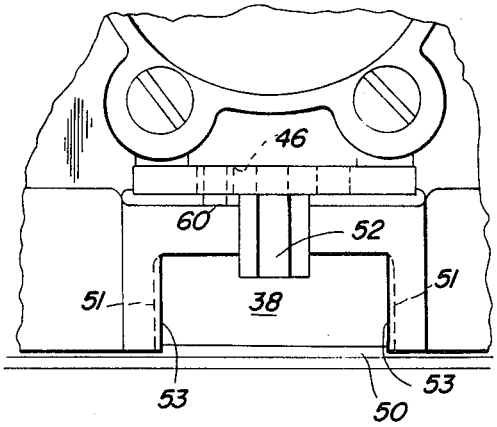
FIG-4
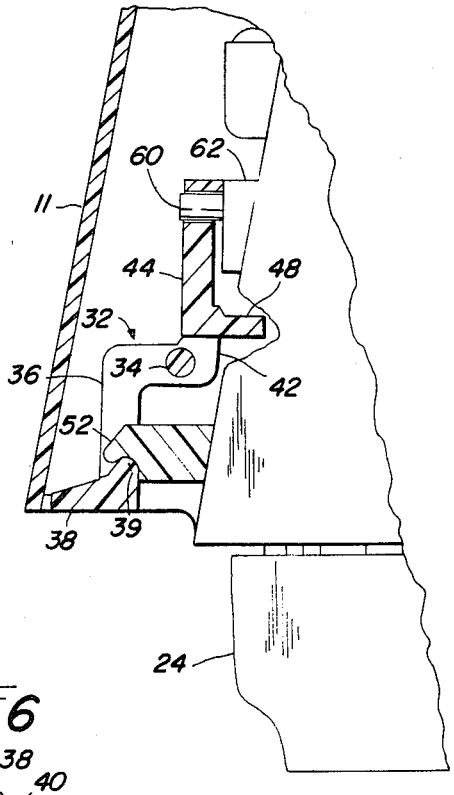
FIG-5
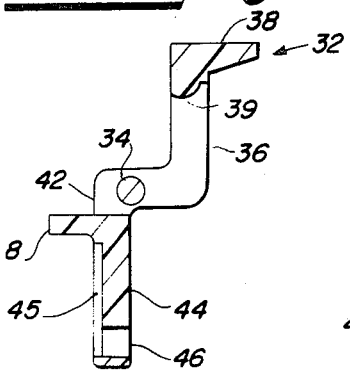
FIG-6
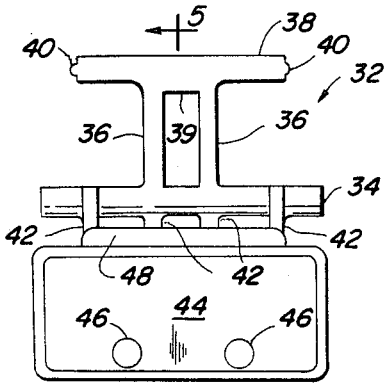
FIG-7
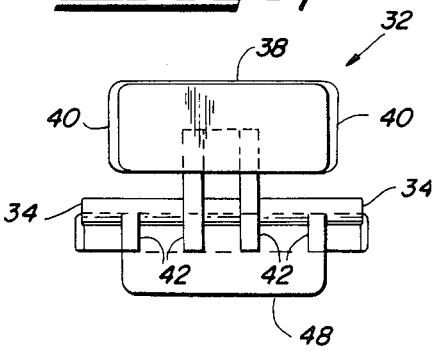
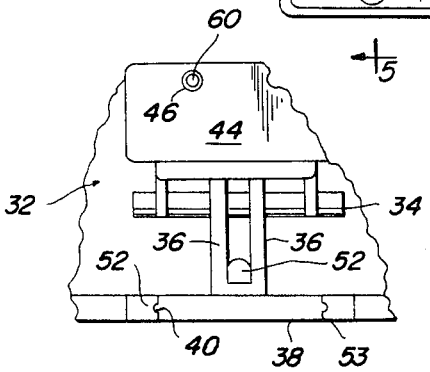
FIG-8

DILUENT VALVE ACTUATOR ASSEMBLY FOR BEVERAGE DISPENSERS

This is a continuation of application Ser. No. 06/343,560, filed Jan. 28, 1982, now abandoned.

BACKGROUND OF THE INVENTION

1. Field of the Invention

This invention relates generally to actuator assemblies for the valves of beverage dispensers in which a diluent (e.g., carbonated water) is mixed with a beverage syrup or concentrate to produce a soft drink. More specifically, this invention relates to an actuator assembly which upon operator contact operates the diluent solenoid valve to allow only the diluent without beverage syrup or concentrate to be dispensed. The present invention also relates to a diluent valve actuator which serves a dual function when in a non-operative position of covering the opening in the dispenser through which the actuator would have extended if the actuator were in the operative position.

2. Description of the Prior Art

Beverage dispensers are in standard use in restaurants, cocktail lounges and in vending machines to mix and provide soft drink beverages such as cola and the like upon demand. Such soft drinks typically comprise a beverage syrup or concentrate which includes all of the ingredients and flavorings mixed with a diluent such as carbonated water, or if a noncarbonated beverage is to be dispensed, plain water. Beverage dispensers are preferred over pre-mixed bottled or canned beverages in some retail situations, such as in restaurants and in some vending machines, because of the reduced storage requirements for unmixed syrup. The weight and bulk associated with finished canned or bottled beverages can add significantly to the transportation and storage costs.

Such beverage dispenser valve arrangements are electromechanical devices usually operated by solenoids such as the fast flow valve arrangement illustrated in U.S. Pat. No. 4,266,726—Brown, et al. assigned to the same assignee as the present application. In the typical restaurant beverage dispensing system, multiple dispensing valves would be provided so that more than one type of beverage could be dispensed. Often, multiple valves for a popular type of beverage are provided to allow adequate dispensing of the more popular beverage during peak demand periods.

However, in many applications, it is desirable to provide means whereby the diluent without mixed syrup or concentrate may be dispensed. For example, in bars and cocktail lounges, plain carbonated water is used in some types of alcoholic beverages as a mixer. Also, restaurants typically provide patrons with glasses of plain water as a courtesy in addition to other beverages that may be purchased. Accordingly, for the purpose of convenience and economy, it is desirable to have beverage dispensing valves in restaurants and lounges which permit the dispensing of plain carbonated and noncarbonated diluent without the addition of beverage syrup or concentrate.

SUMMARY OF THE INVENTION

The present invention comprises an improved actuator assembly for dispensing a diluent from a beverage dispenser valve assembly without the beverage syrup being added to and mixed with the diluent. The actuator assembly is used in connection with a valve assembly for beverage dispensers of the type wherein a diluent and beverage syrup or concentrate are mixed to provide a beverage upon the simultaneous operation of a diluent solenoid valve and a beverage syrup solenoid valve.

The actuator assembly comprises an actuator means which when in a first operative position actuates a switch that operates the diluent solenoid valve upon operator contact. The actuator means is also positionable in a second position if the beverage dispenser valve assembly is not to be used to dispense plain diluent without beverage syrup so that a cover portion of the actuator means fits into and covers an opening in the valve assembly through which the actuator means would have extended if in the first position. The remainder of the actuator means is positioned inside the valve assembly out of the public view.

If at a later time it is desired to modify the beverage dispenser valve assembly to permit dispensing of plain diluent as well as the beverage mixture of diluent and beverage syrup, the actuator can be moved to its operative first position and the appropriate electric switch may be added. Thus, modification to permit diluent dispensing is a simple and economical procedure.

More particularly, a recess is formed along the lower front edge of the beverage dispenser valve assembly with grooves formed in the opposite side edges of the recess. A slightly curved finger extends outwardly over the recess from the back edge. An actuating lever member has a central shaft, a contact plate attached to and extending from the central shaft, and a cover plate attached to the central shaft and extending essentially opposite to the contact plate. The cover plate is dimensioned to coincide with and fill the recess, and it has tongue extensions along opposite edges that mate with the grooves in the side edges of the recess to hold the cover plate in the recess.

The lever member may be positioned in a first operative position with the central shaft being engaged by the finger, with the ends of the central shaft riding on the side edges of the recess, and with the contact plate extending downwardly below the recess. The cover plate extends above the recess and contacts a switch that controls the diluent solenoid valve. Operator pressure on the contact plate causes the lever member to pivot about the central shaft until the cover member actuates the switch causing the diluent solenoid to dispense plain diluent without added beverage syrup.

The lever member is also positionable in a second non-operative position with the tongue extensions along the edge of the cover plate mating with the groove along the edges of the recess to cover the recess. The remainder of the lever member, i.e., the shaft and contact plate extend above the recess and are out of view inside the beverage dispenser valve assembly.

Accordingly, the improved actuator assembly of the present invention serves the dual function of being an actuator to dispense plain diluent and also as a cover member to cover the opening in the dispenser valve assembly when the valve assembly is not being used to dispense plain diluent.

These and other objects, advantages and features of this invention will hereinafter appear, and for the purposes of illustration, but not for limitation, an exemplary embodiment of the subject invention is shown in the accompanying drawings.

BRIEF DESCRIPTION OF THE DRAWINGS

FIG. 3 is a top partially-fragmentary view of the actuator assembly of the present invention shown in the alternative or second non-operative position.

FIG. 4 is a side partially-cross-sectional partially-fragmentary view of the improved actuator assembly in the second non-operative position illustrated in FIG. 3.

FIG. 5 is a side cross-sectional view of the actuator lever of the present invention taken substantially along line 5—5 in FIG. 6.

FIG. 6 is a front plane view of the actuator lever of the present invention.

FIG. 7 is a top view of the actuator lever illustrated in FIGS. 5 and 6.

FIG. 8 is a front partially-fragmentary view of the front of the actuator lever in the position shown in FIGS. 3 and 4.

DETAILED DESCRIPTION OF THE PREFERRED EMBODIMENT

Figure 1:
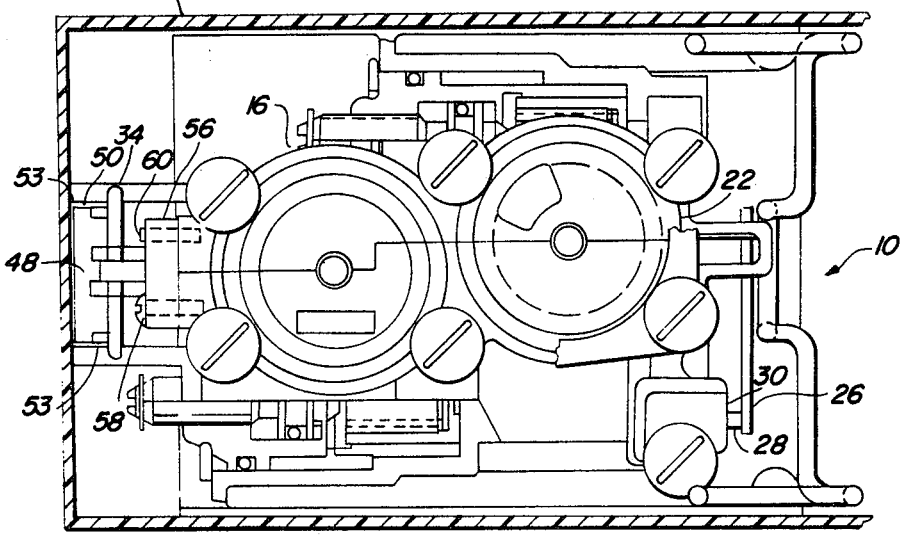
FIG. 1 is a top partially-cross-sectional partially fragmentary view of a beverage dispensing valve assembly with an improved actuator assembly in accordance with the present invention.
Figure 2:
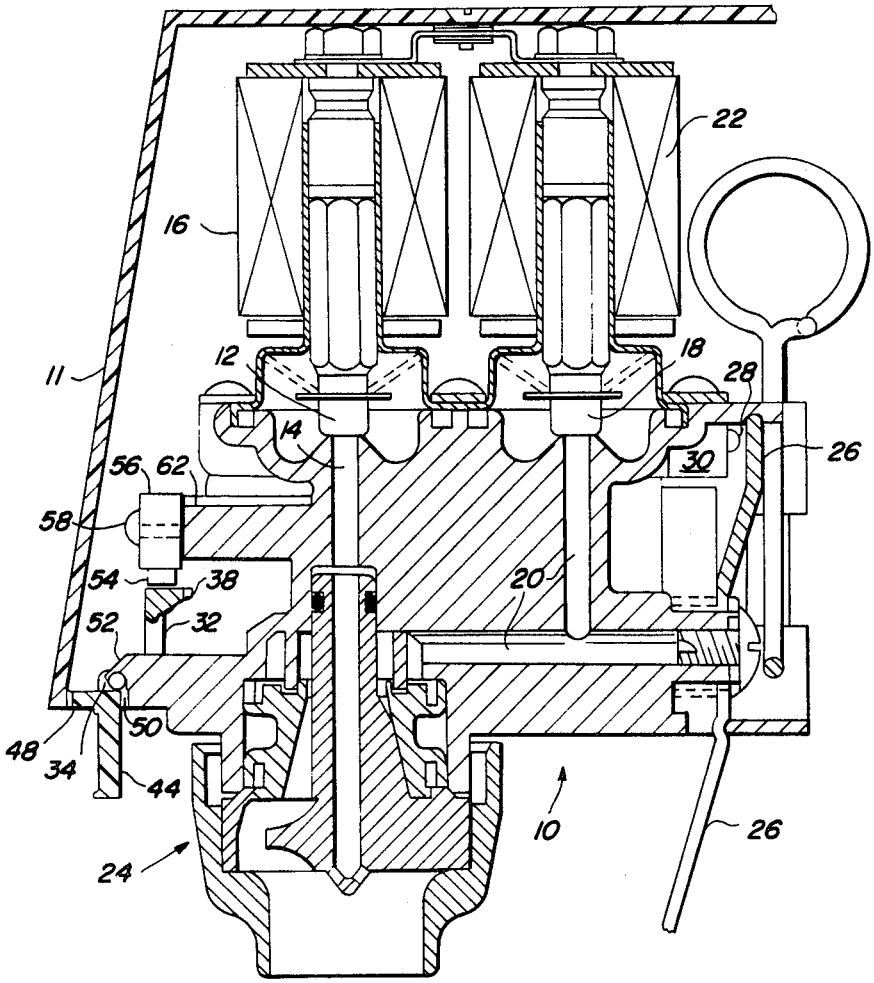
FIG. 2 is a side cross-sectional partially-fragmentary view of the beverage dispensing valve with improved actuator assembly illustrated in FIG. 1.

With reference to FIGS. 1 and 2, a beverage dispenser valve assembly 10 of the type disclosed and described in U.S. Pat. No. 4,266,726—Brown, et al is illustrated. A beverage syrup valve 12 allows the flow of beverage syrup through a syrup passage 14 when syrup valve solenoid assembly 16 is energized. A diluent valve 18 similarly controls the flow of the diluent such as carbonated water or plain water through a diluent passage 20. Diluent valve 18 is operated by the energization of diluent valve solenoid assembly 22.

Diluent passage 20 and syrup passage 14 join at nozzle assembly 24 so that the mixture is dispensed downwardly out of nozzle assembly 24 into a cup or glass. In typical operation, the operator inserts a cup or glass under nozzle 24 and presses against lever 26 causing lever 26 to pivot until the upper end of lever 26 engages a switch button 28 of microswitch 30. Microswitch 30 is wired so that operation of microswitch 30 causes electrical energization of both solenoid 16 and 22 simultaneously thereby causing both diluent valve 22 and syrup valve 12 to open to cause a mixed beverage to be dispensed from nozzle 24.

In many instances, it is desirable to dispense only the diluent, e.g., carbonated or plain water, from the beverage dispenser valve assembly 10. However, as previously pointed out, actuation of lever 26 causes both solenoids 22 and 16 to be energized opening both beverage syrup valve 12 and diluent valve 18 simultaneously. Thus, it is necessary to provide an alternative means of actuating only the diluent solenoid valve 18 to allow plain diluent to be dispensed.

With reference to FIGS. 5, 6 and 7, an actuator lever 32 for dispensing plain diluent is illustrated. The actuator lever 32 comprises a central shaft 34 that has legs 36 mounted thereon and extending outwardly therefrom. A cover plate 38 is mounted on the ends of legs 36, and curved tongue extensions 40 are formed along opposite side edges of cover plate 38.

Also mounted to central shaft 34 by shorter supporting legs 42 is a contact plate 44. Contact plate 44 has two circular openings 46 formed therethrough whose purpose will be described later. Contact plate 44 also has a filler extension 48 which extends approximately perpendicular to contact plate 44 and a recessed area 45 along one face thereof to receive a label that will identify the purpose and means of operation of the contact plate, e.g., "press for plain water."

With reference to FIGS. 1 and 2, a recess 50 is formed at the bottom front edge of beverage dispenser valve assembly 10. Extending outwardly from and above the rear edge of recess 50 is finger 52 which is slightly curved to engage central shaft 34 of actuator lever 32 and allow it to pivot. In FIGS. 1 and 2, lever 32 is shown in its first operative position in which it can be used to operate diluent valve 18 to dispense plain diluent. As may be seen in FIG. 2, contact plate 44 extends downwardly from the bottom of valve assembly 10 and cover plate 38 is positioned within valve assembly 10 behind cover 11 with the base of cover plate 38 resting against a switch button 54 of a microswitch 56. Microswitch 56 is held in position by a screw 58 and a peg 60 which extends from a mounting block 62 molded into the body of valve assembly 10.

Microswitch 56 is wired so that operation of microswitch 56 causes only diluent solenoid 22 to be electrically energized thereby opening only diluent valve 18. As may be seen, by pressing the front of contact plate 44, it will pivot about shaft 34 at the point of engagement with finger 52 and the side edges 53 of recess 50 so that the base of cover plate 38 presses against switch button 54 causing microswitch 56 to energize diluent solenoid 22. Thus, the operator need only position a cup or glass under nozzle 24 without engaging lever 26 and then press contact plate 44 to cause the plain diluent to be dispensed.

However, in most beverage dispenser systems, it is not necessary for all of the beverage dispenser valve assemblies to have the capability of dispensing unmixed diluent. Further, additional unnecessary cost would be involved if all of the valves were designed to dispense both mixed beverage and unmixed diluent. Accordingly, the present invention is designed to permit actuator lever 32 to either serve the function as an actuating lever or to additionally serve the function as a cover member to cover and obscure recess 50 if the particular beverage dispensing valve assembly is not to be used to dispense plain diluent.

With reference to FIGS. 3, 4 and 8, actuating lever 32 is shown in its alternative or second non-operative position as a cover member. As may be seen in FIGS. 3, 4 and 8, actuating lever 32 is turned over and cover plate 38 which is dimensioned to fit recess 50 is inserted into recess 50 so that curved tongue extensions 40 on the side edges of cover plate 38 mate with and engage grooves 51 along opposite side edges 53 of recess 50. In this position, finger 52 extends between legs 36 to engage a curve projection 39 of cover plate 38 formed between legs 36. Peg 60, extending from mounting block 62, engages and extends through one of the holes 46 in contact plate 44 thereby supporting the upper end of actuating lever 32. Microswitch 56 is not needed when the valve assembly 10 is not to be used to dispense plain diluent so it is omitted to permit the hole 46 in contact plate 44 to engage peg 60.

As may be seen, cover plate 38 is dimensioned to substantially fill recess 50 when inserted as illustrated in FIGS. 3, 4 and 8. Accordingly, cover plate 38 of actuating lever 32 closes off recess 50 when the actuator lever is in the non-operative second position as illustrated in FIGS. 3, 4 and 8 thereby eliminating an unsightly and potentially dirt collecting opening at the lower front of the dispensing valve assembly 10. Further, in the non-operative second position illustrated in FIGS. 3, 4 and 8, the actuating lever 32 is nonethelesss available at all times in the dispensing valve assembly 10 so that if at a subsequent time it is desired to modify dispensing valve assembly 10 to permit the dispensing of unmixed plain diluent, it will be very simple to add a microswitch 56 and position the actuating lever 32 in its first operative position.

It should be apparent that various alterations, modifications and changes may be made in the structure of the preferred embodiment illustrated herein without departing from the spirit and scope of the present invention as defined in the appended claims.

I claim:

1. In a valve assembly for a beverage dispenser of the type wherein a diluent and a beverage syrup are mixed to provide a beverage upon simultaneous operation of a diluent solenoid valve and a beverage syrup solenoid valve; an improved actuator assembly for dispensing plain diluent without beverage syrup comprising:

an actuator means for actuating a switch to operate only the diluent solenoid valve upon operator contact when in a first position, said actuator means being positionable in a second position if the valve assembly is not to be used to dispense plain diluent without beverage syrup so that a cover portion of said actuator means fits into an opening of said valve assembly through which said actuator means extends when in its first position to cover said opening so that the remainder of said actuator means is inside said valve assembly out of view.

2. In a valve assembly for a beverage dispenser of the type wherein a diluent and a beverage syrup are mixed to provide a beverage upon simultaneous operation of a diluent solenoid valve and a beverage syrup solenoid valve; and improved actuator assembly for dispensing plain diluent without beverage syrup comprising:

a recess formed along the front of the valve assembly, said recess having opposite side edges with grooves formed along said side edges and a back edge;

a finger extending over the recess at the back edge;

a lever member including a central shaft, a contact plate attached to an extending from said central shaft, a cover plate attached to said central shaft and extending essentially opposite to said contact plate, said cover plate dimensioned to coincide with and fill said recess and said cover plate having tongue extensions along opposite edges to mate with and engage the grooves in the side edges of said recess;

said lever member being positionable with said central shaft resting against the side edges of said recess and pivotably engaged by said finger, with said contact plate extending downwardly below said recess and with said cover plate extending above said recess, said cover plate contacting a switch that controls the diluent solenoid valve, so that operator pressure on said contact plate causes said lever member to pivot about said central shaft until said cover member actuates said switch causing the diluent solenoid valve to dispense plain diluent without beverage syrup;

said lever member also being positionable with the cover plate filling and covering said recess and said tongue extensions along the edges of said cover plate mating with the grooves along the edges of said recess so that said shaft and contact plate are above said recess out of view.

* * * * *